US010145342B2

(12) United States Patent
Takahashi et al.

(10) Patent No.: US 10,145,342 B2
(45) Date of Patent: Dec. 4, 2018

(54) FUEL SUPPLY DEVICE

(71) Applicants: DENSO CORPORATION, Kariya, Aichi-pref. (JP); KYOSAN DENKI CO., LTD., Koga, Ibaraki-pref. (JP)

(72) Inventors: Hideto Takahashi, Kariya (JP); Masaharu Oohashi, Kariya (JP); Tetsuro Okazono, Kariya (JP); Hironobu Oki, Koga (JP)

(73) Assignees: DENSO CORPORATION, Kariya (JP); KYOSAN DENKI CO., LTD., Koga (JP)

( * ) Notice: Subject to any disclaimer, the term of this patent is extended or adjusted under 35 U.S.C. 154(b) by 0 days.

(21) Appl. No.: 15/506,041

(22) PCT Filed: Aug. 26, 2015

(86) PCT No.: PCT/JP2015/004278
§ 371 (c)(1),
(2) Date: Feb. 23, 2017

(87) PCT Pub. No.: WO2016/031238
PCT Pub. Date: Mar. 3, 2016

(65) Prior Publication Data

US 2017/0254303 A1 Sep. 7, 2017

(30) Foreign Application Priority Data

Aug. 29, 2014 (JP) ..... 2014-175193

(51) Int. Cl.
*F02M 37/10* (2006.01)
*F02M 37/18* (2006.01)
(Continued)

(52) U.S. Cl.
CPC ..... *F02M 37/18* (2013.01); *F02M 37/00* (2013.01); *F02M 37/0047* (2013.01);
(Continued)

(58) Field of Classification Search
CPC .. F02M 37/0076; F02M 37/10; F02M 37/106; F02M 2037/225; F02M 2037/226
See application file for complete search history.

(56) References Cited

U.S. PATENT DOCUMENTS 5,762,047 A * 6/1998 Yoshioka ..... F02M 37/10 123/509
7,210,465 B2 * 5/2007 Ikeya ..... B01D 35/027 123/510
(Continued)

FOREIGN PATENT DOCUMENTS

JP 2007-255378 10/2007
JP 2010-216433 9/2010
WO WO 2016/031239 3/2016

OTHER PUBLICATIONS

Takahashi, et al., U.S. Appl. No. 15/506,030, filed Feb. 23, 2017 (39 pages).

*Primary Examiner* — Erick Solis
(74) *Attorney, Agent, or Firm* — Nixon & Vanderhye P.C.

(57) ABSTRACT

A fuel supply device includes a fuel pump, a filter case, a fuel passage, a discharge passage, and a residual pressure holding valve. A communication port opens at a shifted position of the fuel passage that is positionally shifted from the residual pressure holding valve toward the discharge passage. The fuel passage includes an outside passage part through which fuel flows from the communication port toward the discharge passage, and an inside passage part that throttles a flow of fuel flowing from the communication port toward the residual pressure holding valve more than the outside passage part. When a passage cross-sectional area of the inside passage part is converted into a passage cross-sectional area of a circular pipe, D which is a passage diameter of the circular pipe, and L which is a length of the inside passage part satisfy a relational expression of L/D≥3.

10 Claims, 6 Drawing Sheets

(51) Int. Cl.
*F02M 37/00* (2006.01)
*F02M 37/12* (2006.01)
*F02M 37/22* (2006.01)

(52) U.S. Cl.
CPC ..... *F02M 37/0076* (2013.01); *F02M 37/10* (2013.01); *F02M 37/106* (2013.01); *F02M 37/12* (2013.01); *F02M 37/22* (2013.01); *F02M 2037/225* (2013.01); *F02M 2037/226* (2013.01)

(56) References Cited

U.S. PATENT DOCUMENTS

| | | | | |
|---|---|---|---|---|
| 2003/0094161 | A1 | 5/2003 | Suzuki et al. | |
| 2007/0209641 | A1 | 9/2007 | Danjyo | |
| 2009/0095264 | A1* | 4/2009 | Kawajiri | F02M 37/0041 123/506 |
| 2016/0252060 | A1 | 9/2016 | Niwa et al. | |
| 2016/0305381 | A1* | 10/2016 | Byrski | F04F 5/10 |
| 2017/0260943 | A1* | 9/2017 | Hayashi | F02M 37/025 |

* cited by examiner

FUEL SUPPLY DEVICE

CROSS REFERENCE TO RELATED APPLICATION

This application is the U.S. national phase of International Application No. PCT/JP2015/004278 filed on Aug. 26, 2015 which designated the U.S. and claims priority to Japanese Patent Application No. 2014-175193 filed on Aug. 29, 2014, the entire contents of each of which are hereby incorporated by reference.

TECHNICAL FIELD

The present disclosure relates to a fuel supply device that supplies fuel in a fuel tank to an internal combustion engine.

BACKGROUND ART

A fuel supply device that filters fuel, which is pressure-sent from an interior of a fuel tank by a fuel pump, by a fuel filter received in a receiving chamber of a filter case to thereby supply the fuel to an internal combustion engine side outside the filter case has been mounted in a vehicle, thereby having been widely used.

In a device which is a kind of such a fuel supply device and which is disclosed in Patent Document 1, from an inflow port communicating with a receiving chamber on a downstream side of a fuel filter of a fuel passage provided in a filter case, fuel discharged to an internal combustion engine side from a discharge passage is circulated in the fuel passage. In this device disclosed in Patent Document 1, when a fuel pump is stopped, a fuel pressure in the receiving chamber is held by a residual pressure holding valve provided in the filter case to thereby inhibit the fuel from being vaporized, whereby when the fuel is again supplied, a response delay caused by the fuel being vaporized can be avoided.

PRIOR ART DOCUMENT

Patent Document

Patent Document 1: JP 2007-239682A1

Incidentally, in the device disclosed in Patent Document 1, the residual pressure holding valve is a valve of a spring-biased type and opens a valve element against a spring reaction force when the fuel pump is actuated. In this residual pressure holding valve of a spring-biased type, according to a pressure pulsation caused by the fuel being pressure-sent from the fuel pump, the valve element is vibrated and hence the pressure pulsation is amplified, which hence easily causes noise in a path from the fuel passage to the internal combustion engine. Here, the present inventors earnestly conducted research and found the following fact: an inflow port of the residual pressure holding valve functions as a part for throttling a fuel flow, but the inflow port is constructed in such a way that a length is shorter than a diameter, so that the inflow port is insufficient to attenuate the pressure pulsation and to reduce the noise.

SUMMARY OF INVENTION

The present disclosure addresses the above issues. Thus, it is an objective of the present disclosure to provide a fuel supply device that can reduce noise.

To achieve the objective, a fuel supply device in a first aspect of the present disclosure includes a fuel pump, a filter case, a fuel passage, a discharge passage, and a spring-urged type residual pressure holding valve. The filter case receives a fuel filter in its receiving chamber. The fuel supply device filters fuel, which is pressure-sent from an interior of a fuel tank by the fuel pump, through the fuel filter and supplies fuel to an internal-combustion engine. The fuel passage is provided in the filter case and includes a communication port, which communicates with the receiving chamber on a downstream side of the fuel filter. Fuel flows from the communication port through the fuel passage. The discharge passage is provided in the filter case and discharges the fuel flowing through the fuel passage into the internal-combustion engine. The residual pressure holding valve is provided at the filter case and holds a pressure of fuel in the receiving chamber when the fuel pump is stopped. The residual pressure holding valve includes a valve element, which opens the residual pressure holding valve against spring reaction force when the fuel pump is actuated. The communication port opens at a shifted position of the fuel passage that is positionally shifted from the residual pressure holding valve toward the discharge passage. The fuel passage includes an outside passage part and an inside passage part. Fuel flows from the communication port toward the discharge passage through the outside passage part. The inside passage part throttles a flow of fuel flowing from the communication port toward the residual pressure holding valve more than the outside passage part. When a passage cross-sectional area of the inside passage part is converted into a passage cross-sectional area of a circular pipe, D which is a passage diameter of the circular pipe, and L which is a length of the inside passage part satisfy a relational expression of $L/D \geq 3$.

According to this aspect, the residual pressure holding valve that holds the fuel pressure in the receiving chamber when the fuel pump is stopped is a valve of a spring-biased type having the valve element which is opened against a spring reaction force when the fuel pump is actuated. Here, of the fuel passage in which the fuel discharged from the discharge passage to the internal combustion engine side is circulated, the communication port communicating with the receiving chamber on the downstream side of the fuel filter opens at the shifted position which is shifted in position from the residual pressure holding valve to the discharge passage side. In this way, in the fuel passage, the length L of the inside passage part, which throttles the fuel flow from the communication port to the residual pressure holding valve side, can be enlarged in such a way as to satisfy the relational expression of $L/D \geq 3$ as compared with the outside passage part in which the fuel is directed from the communication port to the discharge passage side. As a result, the pressure pulsation caused by the fuel being pressure-sent from the fuel pump can be attenuated by the inside passage part to the residual pressure holding valve of a spring-biased type, so that also the vibration of the valve element in the residual pressure holding valve can be attenuated.

From the above description, in residual pressure holding valve, the pressure pulsation can be inhibited from being amplified by the vibration of the valve element, which hence can reduce noise caused in the path from the fuel passage to the internal combustion engine.

The fuel supply device in a second aspect of the present disclosure further includes a relay passage that is provided in the filter case to communicate between the receiving chamber and the communication port.

According to this aspect, the communication port, which communicates with the receiving chamber via the relay passage, opens at the shifted position which is shifted in position from the residual pressure holding valve to the discharge passage side. According to this construction, not only the length L of the inside passage part, which throttles the fuel flow from the communication port to the residual pressure holding valve side, can be enlarged in such a way as to satisfy the relational expression of $L/D \geq 3$, but also the length of the relay passage from the receiving chamber to the communication port can be enlarged. As a result, before the pressure pulsation which is caused by the fuel being pressure-sent from the fuel pump reaches the residual pressure holding valve, the pressure pulsation can be attenuated by the long relay passage and by the inside passage part which is long extended to thereby throttle the fuel flow. Hence, it is possible to improve an effect of reducing noise.

In a third aspect of the present disclosure, the communication port opens into the outside passage part at the shifted position. The inside passage part opens at a separated position of the outside passage part that is separated from the relay passage with the residual pressure holding valve between the separated position and the relay passage to communicate with the communication port via the outside passage part.

According to this aspect, the communication port, which opens in the outside passage part at the shifted position which is shifted in position from the residual pressure holding valve to the discharge passage side, communicates with the inside passage part via the outside passage part. Here, the fuel flow is more throttled in the inside passage part than in the outside passage part, so that a flow rate of the fuel circulated in the outside passage part so as to be discharged to the internal combustion engine side can be secured and at the same time the pressure pulsation can be attenuated in the inside passage part to thereby reduce noise. Further, the inside passage part opens at the separated position which is separated from the relay passage across the residual pressure holding valve of the outside passage part, so that a distance from the communication port to the separated position of the outside passage part can be increased together with the length of the relay passage. As a result, before the pressure pulsation which is caused by the fuel being pressure-sent from the fuel pump reaches the residual pressure holding valve of a spring-biased type, the pressure pulsation can be attenuated by the long relay passage, the distance secured between the shifted position and the separated position, and the inside passage part which is long extended to thereby throttle the fuel flow. Hence, it is possible to improve the effect of reducing noise.

BRIEF DESCRIPTION OF DRAWINGS

The above and other objects, features and advantages of the present disclosure will become more apparent from the following detailed description made with reference to the accompanying drawings. In the drawings.

EMBODIMENT FOR CARRYING OUT INVENTION

Hereinafter, one embodiment will be described with reference to the drawings.

Figure 1:
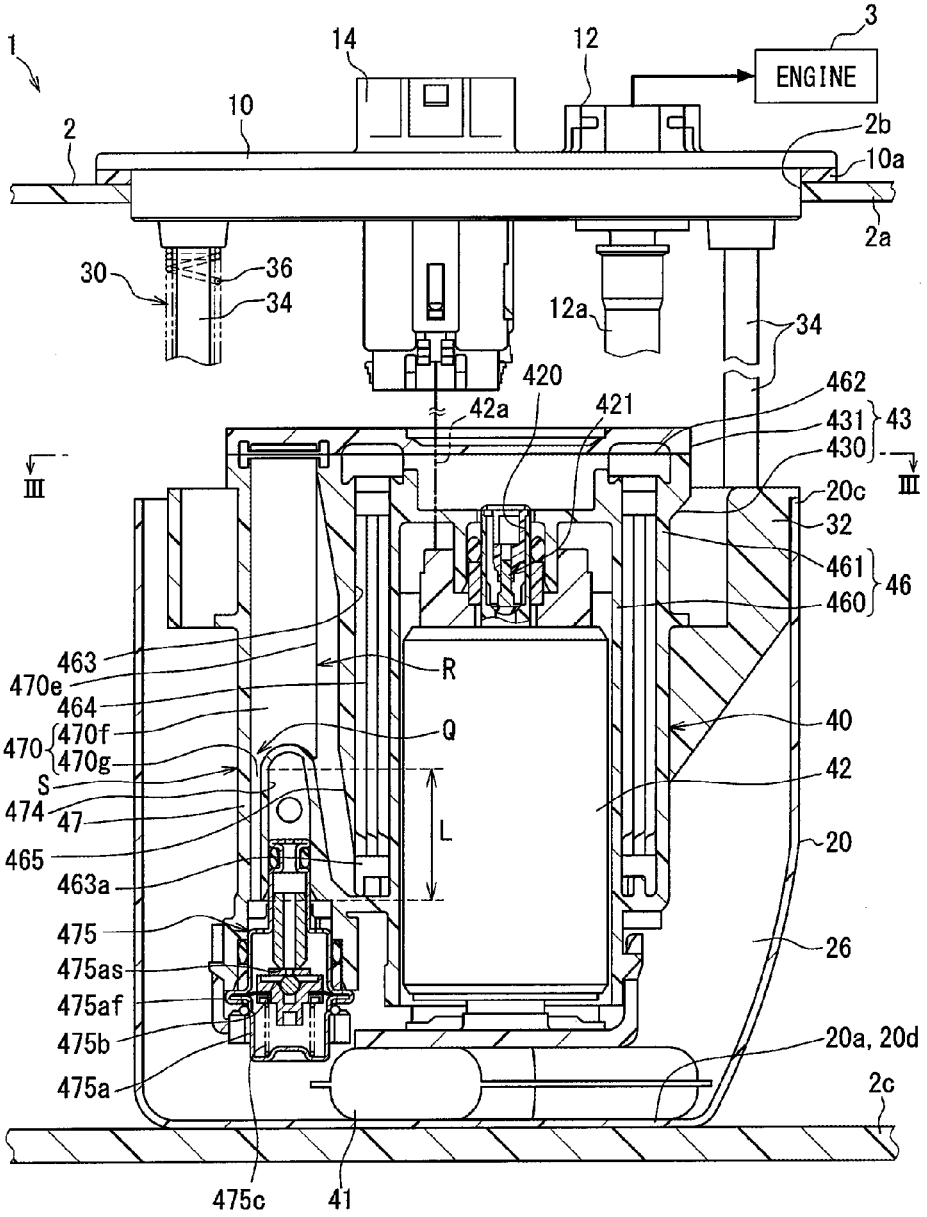
FIG. 1 is a figure to show a fuel supply device according to one embodiment and is a section view taken along a line I-I in FIG. 3.
Figure 2:
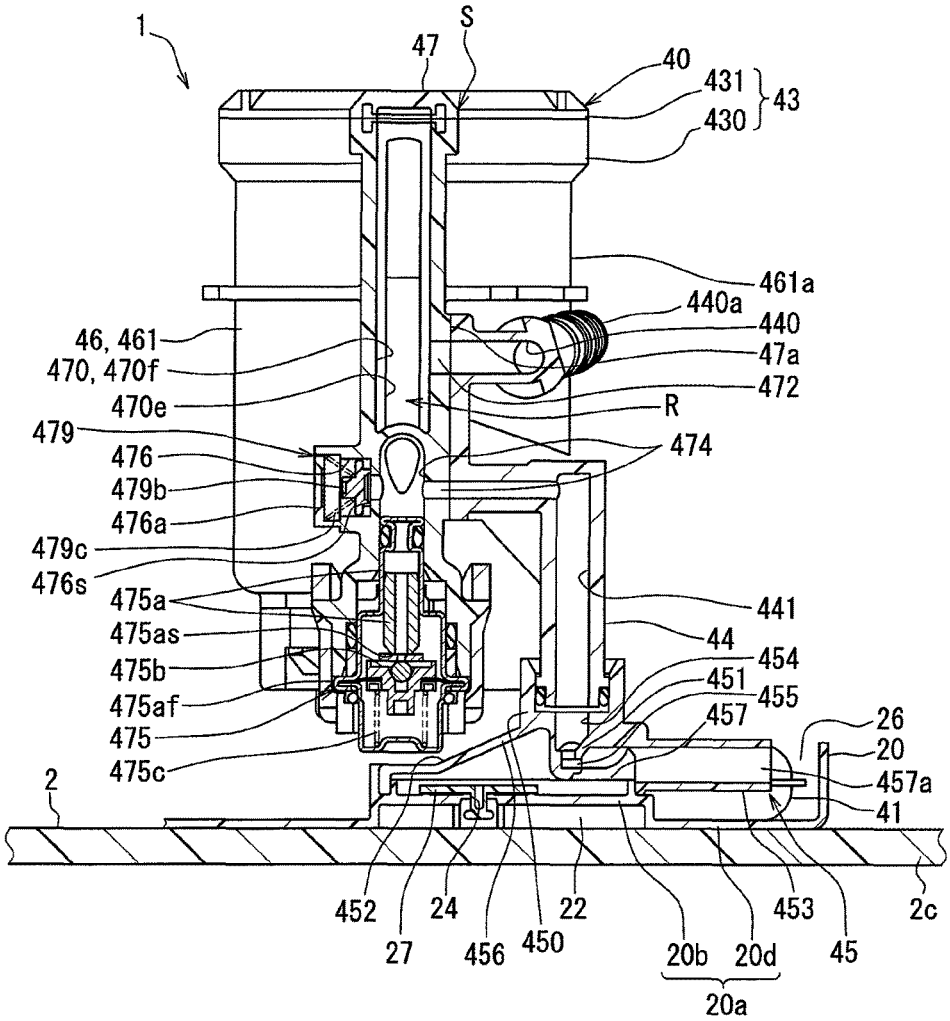
FIG. 2 is a figure to show a pomp unit in FIG. 1 and is a section view taken along a line II-II in FIG. 3.

As shown in FIG. 1 and FIG. 2, a fuel supply device 1 according to one embodiment is mounted in a fuel tank 2 of a vehicle. The fuel supply device 1 supplies fuel in the fuel tank 2 to a fuel injection valve of an internal combustion engine 3 directly or indirectly via a high pressure pump or the like. Here, the fuel tank 2 mounted in the fuel supply device 1 is formed of resin or metal in a hollow shape, thereby storing the fuel to be supplied to the internal combustion engine 3 side. Further, the internal combustion engine 3 to which the fuel is supplied from the fuel supply device 1 may be a gasoline engine or a diesel engine. In this regard, a vertical direction of the fuel supply device 1 shown in FIG. 1 and FIG. 2 substantially matches a vertical direction of the vehicle on a horizontal plane.

Hereinafter, a construction and an action of the fuel supply device 1 will be described.

Figure 3:
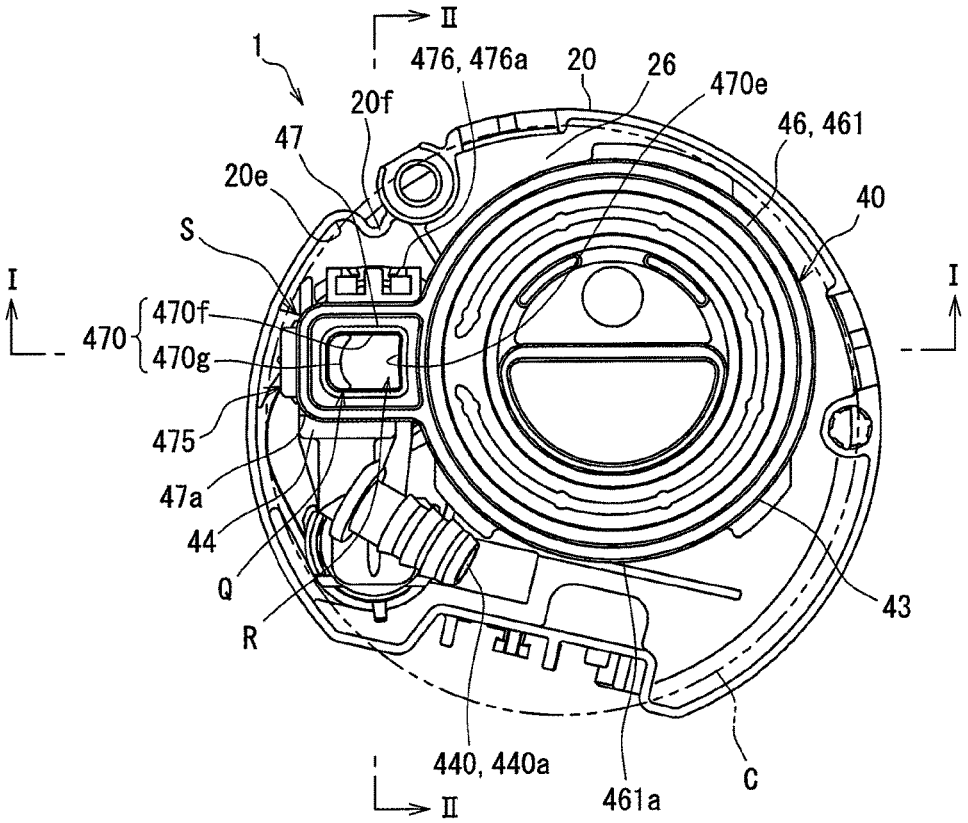
FIG. 3 is a section view taken along a line III-III in FIG. 1.

As shown in FIG. 1 to FIG. 3, the fuel supply device 1 includes a flange 10, a sub-tank 20, a regulation mechanism 30, and a pump unit 40.

As shown in FIG. 1, the flange 10 is made of resin in a shape of a circular disc and is attached to a top plate part 2*a* of the fuel tank 2. The flange 10 closes a through hole 2*b* formed in the top plate part 2*a* by a packing 10*a* sandwiched between the flange 10 and the top plate part 2*a*. The flange 10 is integrally provided with a fuel supply pipe 12 and an electric connector 14.

The fuel supply pipe 12 is protruded to both upper and lower sides from the flange 10. The fuel supply pipe 12 communicates with the pump unit 40 via a flexible tube 12*a* that is freely curved. Since the fuel supply pipe 12 communicates with the pomp unit 40 in this way, the fuel supply pipe 12 supplies the fuel, which is pressure-sent from an interior of the fuel tank 2 by a fuel pump 42 of the pump unit 40, to the internal combustion engine 3 side outside the fuel tank 2. The electric connector 14 is also protruded to both upper and lower sides from the flange 10. The electric connector 14 electrically connects the fuel pump 42 to an external circuit which is not shown in the drawing. By this electric connection, the fuel pump 42 is controlled by the external circuit.

Figure 5:
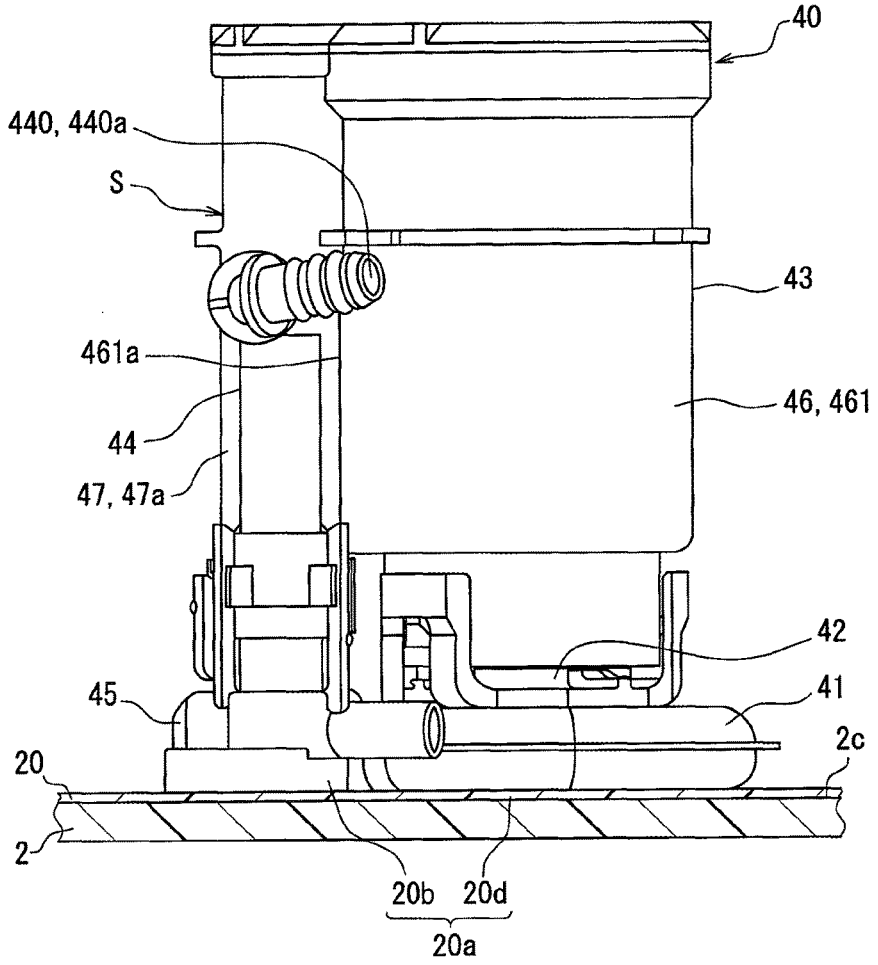
FIG. 5 is a partial section view to show the fuel supply device in FIG. 1.

As shown in FIG. 1, FIG. 2, and FIG. 5, the sub-tank 20 is formed of resin in a shape of a circular cylinder having a bottom and is received in the fuel tank 2. A bottom part 20*a* of the sub-tank 20 is placed on a bottom part 2*c* of the fuel tank 2. Here, as shown in FIG. 2, a depressed bottom part 20*b* depressed upward of the bottom part 20*a* has an inflow space 22 formed between the bottom part 2*c* and the depressed bottom part 2*b* itself. Further, the depressed bottom part 20*b* has an inflow port 24 formed therein. The inflow port 24 communicates with an interior of the fuel tank 2 via the inflow space 22. Since the inflow port 24 communicates with the fuel tank 2 in this way, the inflow port 24 makes the fuel flow into the sub-tank 20, the fuel being transported from the interior of the fuel tank 2 by a jet pump 45 of the pump unit 40. The fuel flowing into the sub-tank 20 through the inflow port 24 is stored in an internal space 26 (see also FIG. 1) of the sub-tank 20 including the surroundings of the fuel pump 42. In this regard, the depressed bottom part 20*b* of the present embodiment has an umbrella valve 27 provided thereon in such a way that the umbrella valve 27 opens the inflow port 24 when a negative pressure is applied from the jet pump 45 which will be described later in detail.

As shown in FIG. 1, the regulation mechanism 30 is constructed of a holding member 32, a pair of support columns 34, a resilient member 36, and the like.

The holding member 32 is formed of resin in a shape of a circular ring and is attached to an upper part 20*c* of the sub-tank 20 in the fuel tank 2. Each of the support columns 34 is formed of metal in a shape of a circular cylinder and is received in the fuel tank 2 and is extended in the vertical direction. An upper end portion of each support column 34 is fixed to the flange 10. Each support column 34 is slidably guided in the vertical direction by the holding member 32 below the upper end portion thereof in a state where each support column 34 is inserted into the sub-tank 20.

The resilient member 36 is formed of metal in a shape of a coil spring and is received in the fuel tank 2. The resilient member 36 is arranged coaxially around one corresponding support column 34. The resilient member 36 is interposed between the corresponding support column 34 and the holding member 32 in the vertical direction. Since the resilient member 36 is interposed in this way, the resilient member 36 presses the bottom part 20*a* of the sub-tank 20 to the bottom part 2*c* of the fuel tank 2 via the holding member 32.

As shown in FIG. 1, FIG. 2, and FIG. 5, the pump unit 40 is received in the fuel tank 2. The pump unit 40 is constructed of a suction filter 41, a fuel pump 42, a filter case 43, a port member 44, the jet pump 45, and the like.

The suction filter 41 is, for example, a non-woven fabric filter or the like and is placed on a deepest bottom part 20*d* surrounding a periphery of the depressed bottom part 20*b* of the bottom part 20*a* in the sub-tank 20. The suction filter 41 filters the fuel to be sucked by the fuel pump 42 from the internal space 26 of the sub-tank 20, thereby removing large foreign matters in the fuel to be sucked.

The fuel pump 42 is arranged above the suction filter 41 in the sub-tank 20. The fuel pump 42 formed, as a whole, in a shape of a circular cylinder has its axial direction substantially matched with the vertical direction. The fuel pump 42 is an electric pump in the present embodiment. The fuel pump 42, as shown in FIG. 1, is electrically connected to the electric connector 14 via a flexible wiring 42*a* which is freely curved. The fuel pump 42 is subjected to a drive control from the external circuit through the electric connector 14, thereby being actuated. Here, while the fuel pump 42 is actuated, the fuel pump 42 sucks the fuel stored around itself through the suction filter 41 and pressurizes the sucked fuel in itself.

The fuel pump 42 is integrally provided with a delivery valve 421 at a delivery port 420 from which the fuel is delivered. The delivery valve 421 is a check valve of a spring-less type in the present embodiment. While the fuel pump 42 is actuated to pressurize the fuel, the delivery valve 421 is opened. When the delivery valve 421 is opened, the fuel is pressure-sent from the delivery port 420 to an interior of the filter case 43. On the other hand, when the fuel pump 42 is stopped to stop pressurizing the fuel, the delivery valve 421 is closed. When the delivery valve 421 is closed, the fuel is stopped from being pressure-sent to the interior of the filer case 43. In the present embodiment, a pressure of the pressurized fuel discharged from the fuel pump 42 is fixed to, for example, 400 kPa.

As shown in FIG. 1 and FIG. 2, the filter case 43 is formed of resin in a hollow shape and is arranged inside and outside the sub-tank 20 in the vertical direction. The filter case 43 is held by the holding member 32, thereby being positioned with respect to the sub-tank 20.

A receiving part 46 of the filter case 43 is formed of an inner cylinder part 460 and an outer cylinder part 461 in a shape of double circular cylinders and is coaxially arranged around the fuel pump 42. Since the receiving part 46 is arranged in this way, an axial direction of the filter case 43 is along the vertical direction. As shown in FIG. 1, the receiving part 46 has a communication chamber 462 formed in a shape of a flat space, the communication chamber 462 communicating with the delivery port 420 above the inner cylinder part 460 and the outer cylinder part 461.

Further, the receiving part 46 has a receiving chamber 463 formed in a shape of a circular cylindrical hole, the receiving chamber 463 communicating with the communication chamber 462 between the inner cylinder part 460 and the outer cylinder part 461. In the receiving chamber 463 is received a fuel filter 464 formed in a shape of a circular cylinder. The fuel filter 464 is made of, for example, a honeycomb filter and filters the pressurized fuel delivered from the delivery port 420 to the receiving chamber 463 via the communication chamber 462, thereby removing minute foreign matters in the pressurized fuel.

Still further, the receiving part 46 has a relay passage 465 formed nearly in a shape of a nearly rectangular hole inclined with respect to an axial direction of the filter case 43 arranged along the vertical direction, the relay passage 465 communicating with the receiving chamber 463. The relay passage 465 communicates with a fuel outlet 463*a*, which opens below the fuel filter 464, of the receiving chamber 463. As the relay passage 465 is further separated from the fuel outlet 463*a* in a radial outward direction, the relay passage 465 is straightly inclined diagonally upward. The relay passage 465 inclined in this way guides the fuel, which is filtered by the fuel filter 464 and sent out from the fuel outlet 463*a*, in a diagonally upward direction.

In this regard, the filter case 43 of the present embodiment is made by bonding a case cap 431 to a case main body 430 by welding. The case main body 430 is a part which forms the receiving chamber 463 of the receiving part 46 and a portion of the communication chamber 462 and which has a bottom. The case cap 431 is a depressed part which forms the relay passage 465 of the receiving part 46 and a remaining portion of the communication chamber 462.

As shown in FIG. 1 to FIG. 3, a protruding part 47 of the filter case 43 protrudes in a radial outward direction directed to a specified position S in a circumferential direction from the outer cylinder part 461 (see also FIG. 5).

In the protruding part 47 are received a fuel passage 470, a discharge passage 472, a branch passage 474, a residual pressure holding valve 475, a relief passage 476, and a relief valve 479. In other words, the protruding part 47 is integrally provided with these elements 470, 472, 474, 475, 476, 479 in a manner deviated at the specified position S in a peripheral direction of the filter case 43.

The fuel passage 470 is formed in a shape of a nearly straight rectangular hole in such a way as to extend straightly in an axial direction of the filter case 43 along the vertical direction in the protruding part 4 7. In a middle portion in the vertical direction of the fuel passage 470 is opened and formed a communication port 470*e*. The fuel passage 470 makes the communication port 470*e* communicate with the receiving chamber 463 via the relay passage 465, thereby being arranged on a downstream side of the fuel filter 464. Since the fuel passage 470 is arranged in this way, the pressurized fuel guided through the relay passage 465 is sent out of the communication port 470*e* to the fuel passage 470. The fuel passage 470 forms an outside passage part 470*f* in which the communication port 470*e* opens and an inside passage part 470*g* which communicates with the communication port 470*e* via the outside passage part 470*f*. The outside passage part 470*f* and the inside passage part 470*g* are received in the protruding part 47 together with the elements 472, 474, 475, 476, 479 at the specified position S.

The outside passage part 470*f* circulates the fuel sent out of the communication part 470*e* to the discharge passage 472 side above the communication port 470*e*. Since the fuel is circulated in this way, a direction in which the fuel is circulated in the relay passage 465, as shown in FIG. 1, is inclined with respect to a direction in which the fuel is circulated in the outside passage part 470*f*. A passage cross-sectional area of the outside passage part 470*f* is made larger than a passage cross-sectional area of the relay passage 465 to relay the communication port 470*e* to the receiving chamber 463.

The fuel, which is guided by the relay passage 465 and sent out of the communication port 470*e*, is folded back to the residual pressure holding valve 475 arranged below through the outside passage part 470*f*, thereby being circulated toward the inside passage part 470*g*. In order to realize this circulation mode, the direction in which the fuel is circulated in the relay passage 465 is inclined also with respect to the direction in which the fuel is circulated in the inside passage part 470*g*. A passage cross-sectional area of the inside passage part 470*g* is made smaller than a passage cross-sectional area of the relay passage 465 and the passage cross-sectional area of the outside passage part 470*f*. Since the inside passage part 470*g* has the passage cross-sectional area made smaller in this way, a fuel flow directed to the residual pressure holding valve 475 side in the inside passage part 470*g* is throttled more than a fuel flow in the outside passage part 470*f*.

Figure 4A:
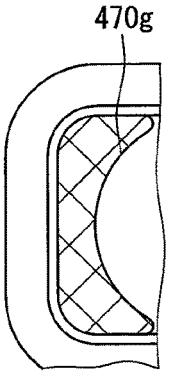
FIG. 4A is a schematic figure to illustrate a feature of the fuel supply device according to one embodiment, showing a minimum passage cross-sectional area of an inside passage part.
Figure 4B:
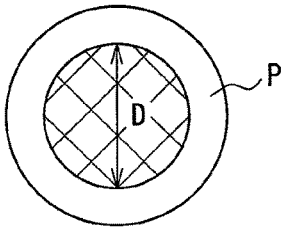
FIG. 4B is a schematic figure to illustrate a feature of the fuel supply device according to one embodiment, showing a passage cross-sectional area of a circular pipe.

Here, a minimum passage cross-sectional area of the inside passage part 470*g*, which is denoted by hatching in FIG. 4A, is imaginarily transformed as a passage cross-sectional area of a circular pipe P, which is denoted by hatching in FIG. 4B. Then, a passage diameter D of the circular pipe P, which is shown in FIG. 4B and is found from the transformed passage cross-sectional area, and a length L of the inside passage part 470*g*, which is shown in FIG. 1 and is found as a distance from the outside passage part 470*f* to the residual pressure holding valve 475, are set in such a way as to satisfy a relational expression of $L/D \geq 3$. Here, a reason why the passage diameter D and the length L are set in such a way as to satisfy the relational expression of $L/D \geq 3$ will be described later in detail.

Further, the residual pressure holding valve 475 arranged on the downstream side of the inside passage part 470*g*, as shown in FIG. 1 to FIG. 3, is arranged separately below the discharge passage 472. In this arrangement, in the outside passage part 470*f*, the communication port 470*e* opens at a shifted position R, which is shifted in position from the residual pressure holding valve 475 to the discharge passage 472, and the inside passage part 470*g* opens below the shifted position R. Further, as shown in FIG. 1 and FIG. 3, an opening of the inside passage part 470*g* is formed at a separated position Q which is separated in the radial outward direction across the residual pressure holding valve 475 from the relay passage 465 of the outside passage part 470*f*.

As shown in FIG. 2, the discharge passage 472 is formed in a shape of a circular cylinder which is provided in a middle portion in the vertical direction of the protruding part 47 and which is positioned above the communication port 470*e*. The discharge passage 472 is branched in a direction orthogonal to the axial direction of the filter case 43 from the downstream side of the communication port 470*e* in the outside passage part 470*f* of the fuel passage 470. The discharge passage 472 communicates with a discharge port 440 of a port member 44, thereby discharging the fuel circulated in the fuel passage 470 to the internal combustion engine 3 side through the flexible tube 12*a* and the fuel supply pipe 12.

As shown in FIG. 1 and FIG. 2, the branch passage 474 is formed in a shape of a space expanding from a position, which is sandwiched between the relay passage 465 and the inside passage part 470*g* at the separated position Q in the radial outward direction of the protruding part 47, to the port member 44 side. The branch passage 474 is branched in a such a way as to be folded back upward from a lower end opposite to the outside passage part 470*f* of the inside passage part 470*g*. The branch passage 474 communicates with a jet port 441 of the port member 44, thereby guiding the fuel discharged from the inside passage part 470*g* through the residual pressure holding valve 475 to the jet pump 45.

The residual pressure holding valve 475 is a check valve of a spring-biased type and is provided in the branch passage 474. The residual pressure holding valve 475 is provided with a valve housing 475*a*, a valve element 475*b*, and a valve spring 475*c*.

The valve housing 475*a* is formed of a composite material of metal in a shape of a stepped circular cylinder and is fitted in the protruding part 47. A portion of the branch passage 474 is passed through the valve housing 475*a*. The valve housing 475*a* has a plate-shaped valve seat 475*as* formed in the branch passage 474. Further, in the valve housing 475*a*, a flange part 475*af* shaped like a circular ring plate is provided below the relay passage 465 and below the inside passage part 470*g* in such a way as to overlap the relay passage 465 and the inside passage part 470*g*, whereby the residual pressure holding valve 475 is positioned by the protruding part 47 and the fuel supply device 1 is reduced in size.

The valve element 475*b* is formed of a composite material of metal in a shape of a circular cylinder and is received coaxially in the valve housing 475*a*. Since the valve element 475*b* is received in this way, when the valve element 475*b* is moved back and forth, the valve element 475*b* can be seated on and separated from the valve seat 475*as*. Hence, when the valve element 475*b* is separated from the valve seat 475*as*, the residual pressure holding valve 475 is opened. On the other hand, when the valve element 475*b* is seated on the valve seat 475*as*, the residual pressure holding valve 475 is closed.

The valve spring 475*c* is formed of metal in a shape of a coil and is retained coaxially in the valve housing 475*a*. The valve spring 475*c* biases the valve element 475*b* to the valve seat 475*as* side by a spring reaction force.

According to this structure, the residual pressure holding valve 475 opens or closes the fuel passage 470 communicating with the branch passage 474. Specifically, while the fuel pump 42 is actuated to send out the fuel, the pressure of which is higher than a set pressure, from the communication passage 470*e* to the outside passage part 470*f* and the inside passage part 470*g*, the valve element 475*b* of the residual pressure holding valve 475 is opened against the spring reaction force of the valve spring 475*c*. When the valve element 475*b* of the residual pressure holding valve 475 is opened, in a state where the valve element 475*b* is resiliently held by the valve spring 475*c*, the pressurized fuel flowing into the branch passage 474 from the inside passage part 470*g* is circulated to the side of the jet pump 45 and the relief valve 479. In this way, the pressure of the pressurized fuel directed to the discharge passage 472 from the outside passage part 470*f* is regulated to, for example, 400 kPa. In other words, a pressure regulation function is exerted to the fuel discharged from the discharge passage 472 to the internal combustion engine 3 side by the opened residual pressure holding valve 475. On the other hand, even if the fuel pump 42 is actuated, when the pressure of the fuel sent out of the communication port 470*e* is made less than the set pressure, or when the fuel pump 42 is stopped to thereby stop sending out the fuel from the communication port 470*e*, the valve element 475*b* is closed by the spring reaction force of the valve spring 475*c*. When the valve element 475*b* is closed, a circulation of the fuel directed to the jet pump 45 and the relief valve 479 side is also stopped, so that especially in a case where the fuel pump 42 is stopped and the valve element 475*b* is closed, the delivery valve 421 is also closed and hence the pressure of the fuel in the receiving chamber 463 is held at the set pressure of the residual pressure holding valve 475. In other words, the residual pressure holding function is exerted to the fuel stored in the receiving chamber 463 by the closed residual pressure holding valve 475. In this regard, a pressure held by the residual pressure holding function of the residual pressure holding valve 475 is set to, for example, 400 kPa.

Figure 6:
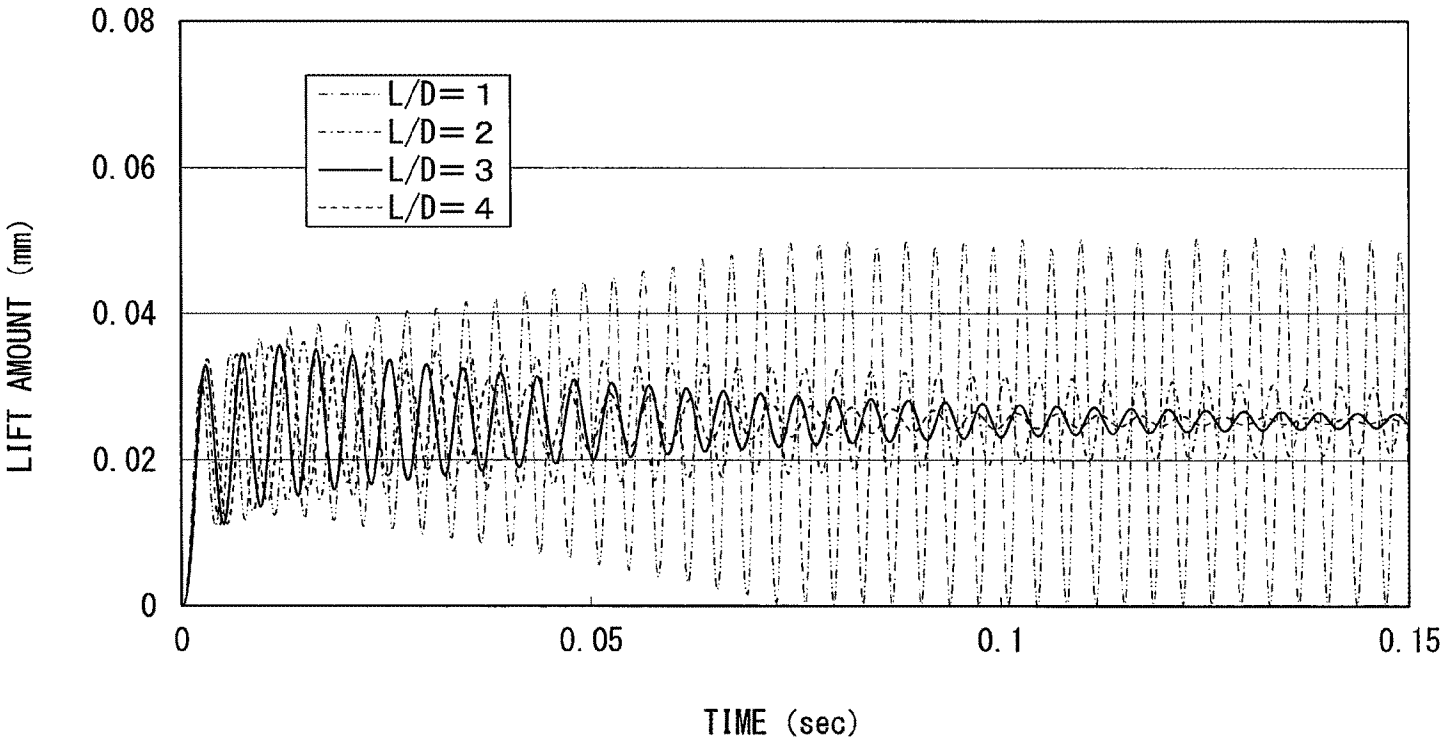
FIG. 6 is a characteristic diagram to show an operation and effect of the fuel supply device according to one embodiment.
Figure 7:
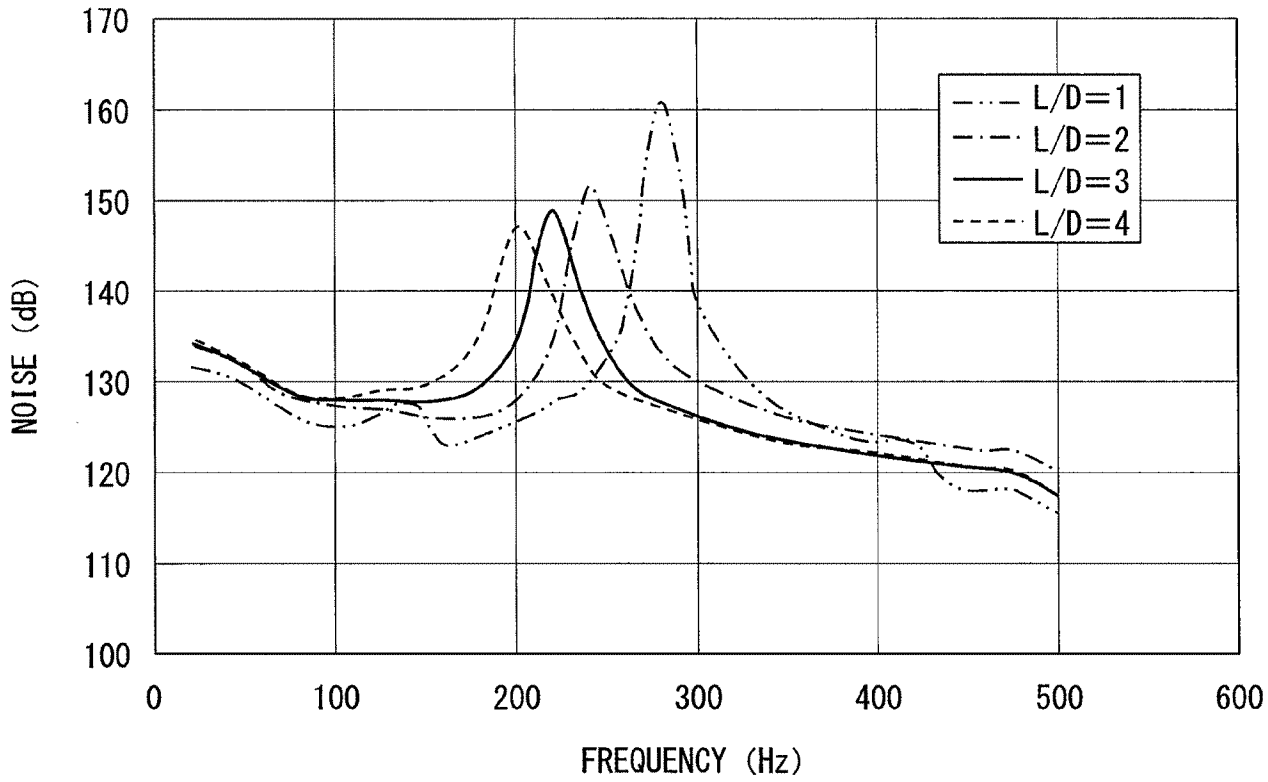
FIG. 7 is a characteristic diagram to show an operation and effect of the fuel supply device according to one embodiment.

In the residual pressure holding valve 475 to construct a spring-mass system in this way, there is a concern that the valve element 475*b* when a lift amount (amount of separation from the valve seat) from the valve seat 475*as* is small or the like is subjected to a pressure pulsation caused by the fuel being pressure-sent from the fuel pump 42 and is hence vibrated. However, as described above, in the present embodiment, the passage diameter D of the circular pipe P, which is transformed from the passage cross-sectional area of the inside passage part 470*g*, and the length L of the inside passage part 470*g* are set in such a way as to satisfy the relational expression of $L/D \geq 3$. As a result of this setting, a vibration of the valve element 475*b* caused by the pressure pulsation, as shown in FIG. 6, is attenuated substantially to a zero level as time elapses. Hence, as shown in FIG. 7, noise caused in a path from the fuel passage 470 to the internal combustion engine 3 can be reduced. In this regard, in FIG. 6 and FIG. 7, a case where $L/D=3$ and a case where $L/D=4$ are shown as the present embodiment, whereas a case where $L/D=1$ and a case where $L/D=2$ are shown as comparative examples.

As shown in FIG. 2, the relief passage 476 is formed in a shape of a stepped circular cylindrical hole in a middle portion positioned between the discharge passage 472 and the residual pressure holding valve 475 in the vertical direction of the protruding part 47. The relief passage 476 is branched to a direction orthogonal to the axial direction of the filter case 43 from the downstream side of the residual pressure holding valve 475 in the branch passage 474 and communicates with the relief valve 479 on a side opposite to a branch position in which relief passage 476 is branched. Since the relief passage 476 communicates with the relief valve 479 in this way, the relief passage 476 guides the fuel discharged from the inside passage part 470*g* through the residual pressure holding valve 475 to the relief valve 479.

The relief valve 479 is a check valve of a spring-biased type and is provided in the relief passage 476. The relief valve 479 communicates with the internal space 26 of the sub-tank 20 through the relief passage 476, thereby being able to discharge the fuel guided in the relief passage 476 to the internal space 26. The relief valve 479 is provided with a valve element 479*b* and a valve spring 479*c*.

The valve element 479*b* is formed of a composite material of resin and rubber in a shape of a circular disc. The valve element 479*b* is received coaxially in a most downstream end 476*a* on the downstream side of a stepped portion, which forms a valve seat 476*s* in a shape of flat plane, of the relief passage 476. Since the valve element 479*b* is received in this way, when the valve element 479*b* is moved back and forth, the valve element 479*b* can be seated on and separated from the valve seat 476*s*. Hence, when the valve element 479*b* is separated from the valve seat 476*s*, the relief valve 479 is opened. On the other hand, when the valve element 479*b* is seated on the valve seat 476*s*, the relief valve 479 is closed.

The valve spring 479*c* is formed of metal in a shape of a coil and is retained coaxially in the relief passage 476. The valve spring 479*c* biases the valve element 479*b* to the valve seat 476*s* side by a spring reaction force.

The relief valve 479 constructed in this way opens or closes the fuel passage 470 communicating with the relief passage 476 via the branch passage 474. Specifically, irrespective of the fuel pump 42 being actuated or stopped, while the residual pressure holding valve 475 is closed and the pressure in the relief passage 476 is less than a relief pressure, the valve element 479*b* of the relief valve 479 is closed by the spring reaction force of the valve spring 479*c*. When the valve element 479*b* of the relief valve 479 is closed, the residual pressure holding valve 475 is also in a closed state and hence the fuel is not circulated to the jet pump 45 side. On the other hand, when the fuel pump 42 is actuated and the residual pressure holding valve 475 is opened and the fuel more than the relief pressure is discharged from the inside passage part 470*g* by the residual pressure holding valve 475, the valve element 479*b* is opened against the spring reaction force of the valve spring 479*c*. When the valve element 479*b* is opened, in a state where the valve element 479*b* is resiliently held by the valve spring 479*c*, the fuel is discharged from the inside passage part 470*g* to the internal space 26 of the sub-tank 20 through the residual pressure holding valve 475, so that the pressure of the fuel directed to the jet pump 45 side is relieved to the relief pressure. In other words, a relief function is exerted to the fuel, which is discharged from the fuel passage 470 by the residual pressure holding valve 475, by the opened relief valve 479. In this regard, the relief pressure by the relief function of the relief valve 479 is set to, for example, 50 kPa.

Here, as shown in FIG. 3, the most downstream end 476*a* of the relief passage 476 opens in such a way to be opposite to an inner peripheral face 20*e* of the sub-tank 20 to receive the pump unit 40 constructed of the fuel pump 42, the filter case 43 and the like. The fuel discharged from the relief valve 479 flows into the internal space 26 of the sub-tank 20 through the most downstream end 476*a* of the relief passage 476. Hence, in order to relieve a flow of the fuel, which is discharged from the relief valve 479 through the most downstream end 476*a*, to a lateral direction, the inner peripheral face 20*e* of the sub-tank 20 is projected in a shape of a mountain at a position opposite to the most downstream end 476*a*, thereby forming a flow-directing part 20*f*.

As shown in FIG. 2, the port member 44 is formed of resin in a hollow shape and is arranged in the sub-tank 20. As shown in FIG. 2, FIG. 3, and FIG. 5, the port member 44 is bonded to the protruding part 47 at the specified position S by welding. The port member 44 is projected from the protruding part 47 in a direction orthogonal to the axial direction of the filter case 43. Here, in particular, in the present embodiment, an amount of projection of the port member 44 is set in such a way that a diameter of a circumscribed circle C (see FIG. 3) is made as small as possible, the circumscribed circle C being tangent to an outer periphery of the filter case 43 including an outer periphery of the protruding part 47 which is an outer periphery of the specified position S and being tangent also to an outer periphery of the port member 44.

The port member 44 is integrally provided with the discharge port 440 and the jet port 441 outside the filter case 43.

The discharge port 440 is formed in a shape of a space shaped like a letter L in an upper portion in the vertical direction of the port member 44. The discharge port 440 is formed in such a way as to bend along an outer peripheral face 461*a* of the outer cylinder part 461 curved in a shape of a cylindrical face of the filter case 43 and has the most downstream end 440*a* directed in the lateral direction, thereby communicating with the flexible tube 12*a*. Here, the lateral direction to which the most downstream end 440*a* of the discharge port 440 is directed is inclined slightly upward from a direction orthogonal to the axial direction of the filter case 43 along the vertical direction. Further, as shown in FIG. 2, the discharge port 440 communicates with the discharge passage 472 to open in the side face 47*a* of the protruding part 47 on a side opposite to the most downstream end 440*a*. Since the discharge port 440 communicates with the discharge passage 472 in this way, the discharge port 440 communicates with the fuel passage 470 in the filter case 43 through the discharge passage 472 and communicates with the internal combustion engine 3 side outside the filter case 43 via the flexible tube 12*a* and the fuel supply pipe 12. The discharge port 440 which makes the inside and the outside of the filter case 43 communicate with each other in this way discharges the fuel, which is circulated from the fuel passage 470 to the discharge passage 472, to the internal combustion engine 3 side.

The jet port 441 is formed in a shape of a space shaped like an inverse letter L in a lower end portion positioned below the discharge port 440 of the port member 44. The jet port 441 communicates with the branch passage 474 opening in the side face 47*a* of the protruding part 47 and communicates with the jet pump 45 on a side opposite to a position in which the jet port 441 communicates with the branch passage 474. Since the jet port 441 communicates with the branch passage 474 and the jet pump 45 in this way, the jet port 441 communicates with the inside passage part 470*g* in the filter case 43 via the branch passage 474 and directly communicates with the jet pump 45 outside the filter case 43. The jet port 441, which makes the inside and the outside of the filter case 43 communicate with each other, exerts a guide action directed to the jet pump 45 to the fuel discharged from the fuel passage 470 through the residual pressure holding valve 475.

As shown in FIG. 2 and FIG. 5, the jet pump 45 is formed of resin in a hollow shape and is arranged below the port member 44 in the sub-tank 20. The jet pump 45 is placed especially on the depressed bottom part 20*b* of the bottom part 20*a* of the sub-tank 20. Since the jet pump 45 is placed in this way, the jet pump 45 and the port member 44 overlap the inflow port 24 in the axial direction of the filter case 43 above the bottom part 20*a* shown in FIG. 2. The jet pump 45 is integrally provided with a pressuring part 450, a nozzle part 451, a suction part 452, and a diffuser part 453.

The pressurizing part 450 has a pressurizing passage 454 formed in a shape of a stepped circular cylindrical hole extending along the axial direction of the filter case 43. The pressurizing passage 454 is positioned below the port member 44 and communicates with the jet port 441. Since the pressurizing passage 454 communicates with the jet port 441 in this way, the pressurized fuel discharged from the inside passage part 470*g* through the residual pressure holding valve 475 inside the filter case 43 is guided to the pressurizing passage 454 via the jet port 441 outside the filter case 43.

The nozzle part 451 has a nozzle passage 455 formed in a shape of a circular cylindrical hole extending in a direction orthogonal to the axial direction of the filter case 43. The nozzle passage 455 is positioned below the pressuring part 450 and communicates with the pressuring passage 454. Further, the nozzle passage 455 has its passage cross-sectional area reduced as compared with the inside passage part 470*g* and the pressuring passage 454 on the upstream side thereof. Since the nozzle part 451 communicates with the pressurizing passage 454 and is reduced in the passage cross-sectional area in this way, the pressurized fuel guided to the pressurizing passage 454 flows into the nozzle passage 455.

The suction part 452 has a suction passage 456 formed in a shape of a flat space expanding in the direction orthogonal to the axial direction of the filter case 43. The suction passage 456 is positioned below the pressurizing part 450 and the nozzle part 451 and communicates with the inflow port 24. Since the suction passage 456 communicates with the inflow port 24 in this way, the fuel flowing into the sub-tank 20 through the inflow port 24 is circulated in the suction passage 456.

The diffuser part 453 has a diffuser passage 457 formed in a shape of a circular cylindrical hole extending in the direction orthogonal to the axial direction of the filter case 43. The diffuser passage 457 is positioned below the pressurizing part 450 and communicates with the nozzle passage 455 and communicates with the internal space 26 of the sub-tank 20 on a side opposite to a position in which the diffuser passage 457 communicates with the nozzle passage 455. Further, the diffuser passage 457 has its passage cross-sectional area enlarged as compared with the nozzle passage 455. Since the diffuser passage 457 communicates with the nozzle passage 455 and the internal space 26 and has the passage cross-sectional area enlarged in this way, when the pressurized fuel, which flows into the nozzle passage 455 and has its flow rate reduced, is jetted out to the diffuser passage 457 to cause a negative pressure around a jetted flow, the fuel in the fuel tank 2 is sucked from the inflow port 24 into the suction passage 456 and the diffuser passage 457 in sequence. The fuel sucked in this way is subjected to a diffuser action in the diffuser passage 457 and is pressure-sent, thereby being transported to the internal space 26 including the surroundings of the fuel pump 42.

In this regard, in the present embodiment, the diffuser passage 457, which has a cross section formed in a circular shape having a large diameter, has its center aligned with the nozzle passage 455, which has a cross section formed in a circular shape having a small diameter. In addition, the most downstream end 457*a*, which communicates with the internal space 26 in the diffuser passage 457 of the present embodiment, is separated upward from the deepest bottom part 20*d* of the bottom part 20*a* of the sub-tank 20.

An operation and effect of the present embodiment described above will be described below.

According to the present embodiment, the residual pressure holding valve 475, which holds the fuel pressure in the receiving chamber 463 when the fuel pump 42 is stopped, is the valve of a spring-biased type having the valve element 475*b* which is opened against the spring reaction force when the fuel pump 42 is actuated. Here, of the fuel passage 470 in which the fuel discharged to the internal combustion engine 3 side from the discharge passage 472 is circulated, the communication port 470*e*, which communicates with the receiving chamber 463 on the downstream side of the fuel filter 464, opens at the shifted position R which is shifted in position from the residual pressure holding valve 475 to the discharge passage 472 side. In this way, in the fuel passage 470, the length L of the inside passage part 470*g*, which throttles the fuel flow from the communication port 470*e* toward the valve 475, can be enlarged in such a way as to satisfy the relational expression of $L/D \geq 3$ as compared with the outside passage part 470*f* in which the fuel is directed from the communication port 470*e* to the discharge passage 472 side. As a result, the pressure pulsation caused by the fuel being pressure-sent from the fuel pump 42 can be attenuated by the inside passage part 470*g* which is long extended to the residual pressure holding valve 475 of a spring-biased type to thereby throttle the fuel flow, so that also the vibration of the valve element 475*b* in the residual pressure holding valve 475 can be attenuated.

From the above description, in the residual pressure holding valve 475, the pressure pulsation can be inhibited from being amplified by the vibration of the valve elements 475*b*. Hence, it is possible to reduce noise caused in the path from the fuel passage 470 to the internal combustion engine 3.

Further, according to the present embodiment, the communication port 470*e*, which communicates with the receiving chamber 463 via the relay passage 465, opens at the shifted position R. According to this, not only the length L of the inside passage part 470*g*, which throttles the fuel flow from the communication port 470*e* to the residual pressure holding valve 475, can be enlarged in such a way as to satisfy the relational expression of $L/D \geq 3$, but also the length of the relay passage 465 from the receiving chamber 463 to the communication port 470*e* can be enlarged. As a result, before the pressure pulsation caused by the fuel being pressure-sent from the fuel pump 42 reaches the residual pressure holding valve 475 of a spring biased type, the pressure pulsation can be attenuated by the long relay passage 465 and by the inside passage part 470*g* which is long extended to thereby throttle the fuel flow. Hence, it is possible to improve an effect of reducing noise.

Further, according to the present embodiment, the communication port 470*e* opening in the outside passage part 470*f* at the shifted position R communicates with the inside passage part 470*g* via the outside passage part 470*f*. Here, the fuel flow is more throttled in the inside passage part 470*g* than in the outside passage part 470*f*, so that it is possible to secure the flow rate of the fuel, which is circulated in the outside passage part 470*f* so as to be discharged to the internal combustion engine 3 side, and at the same time to attenuate the pressure pulsation in the inside passage part 470*g* to thereby reduce noise. Further, the inside passage part 470*g* opens at the separated position Q which is separated in the radial outward direction from the relay passage 465 across the residual pressure holding valve 475 of the outside passage part 470*f*, so that a distance from the communication port 470*e* to the separated position Q of the outside passage part 470*f* can be increased together with the length of the relay passage 465. As a result, before the pressure pulsation which is caused by the fuel being pressure-sent from the fuel pump 42 reaches the residual pressure holding valve 475 of a spring biased type, the pressure pulsation can be attenuated by the long relay passage 465, a distance secured between the shifted position R and the separated position Q, and the inside passage part 470*g* which is long extended to thereby throttle the fuel flow. Hence, it is possible to improve the effect of reducing noise.

Still further, according to the present embodiment, the direction in which the fuel is circulated in the inside passage part 470*g* is inclined with respect to the direction in which the fuel is circulated in the relay passage 465. In this way, the fuel flow from the relay passage 465 to the inside passage part 470*g* through the outside passage part 470*f* is smoothly folded back, which hence makes it difficult for the fuel flow to separate from an inner surface forming the outside passage part 470*f* and the inside passage part 470*g*. Hence, it is possible to inhibit a negative pressure from being produced by the separation of the fuel flow to thereby cause noise.

In addition, according to the present embodiment, in the protruding part 47 protruding from the specified position S in the peripheral direction of the filter case 43 are received not only the residual pressure holding valve 475 at the separated position Q but also the outside passage part 470*f* and the inside passage part 470*g*. According to this protruding part 47, the distance between the shifted position R and the separated position Q can be secured and at the same time the diameter of the circumscribed circle C can be reduced, the circumscribed circle C being tangent to the outer periphery of the filter case 43 including the specified position S in which the residual pressure holding valve 475 is provided together with the outside passage part 470*f* and the inside passage part 470*g*. Hence, it is possible to achieve both of the effect of reducing noise and an effect of reducing the size of the fuel supply device 1.

In addition, according to the present embodiment, not only the outside passage part 470*f* and the inside passage part 470*g* but also the residual pressure holding valve 475 and the discharge passage 472 are integrally provided in a manner deviated at the specified position S. According to this construction, in a state where the circumscribed circle C tangent to the outer periphery of the filter case 43 is reduced in a diameter, the pressure pulsation can be attenuated by the inside passage part 470*g* to satisfy the relational expression of $L/D \geq 3$, which is related to the elements 475, 472, and 470*f*. Hence, it is possible to produce an effect of reducing noise and at the same time to reduce the size of the fuel supply device 1.

In further addition, according to the present embodiment, even if the pressure of the fuel discharged from the inside passage part 470*g* through the residual pressure holding valve 475 is increased, for example, by an action to throttle the fuel by the jet pump 45, the increased pressure of the fuel can be relieved. According to this relief function, the pressure regulation function of the residual pressure holding valve 475 to regulate the pressure of the fuel directed to the discharge passage 472, that is, the pressure of the fuel discharged to the internal combustion engine 3 side can be stably exerted. Further, the fuel from the inside passage part 470*g* can reach the relief valve 479 of a spring-biased type, in which the valve element 479*b* is opened against the spring reaction force so as to relieve the pressure, through the residual pressure holding valve 475. In this way, not only by the action of the inside passage part 470*g* which is long extended to throttle the fuel flow in such a way to satisfy the relational expression of L/D≥3, but also by the distance from the communication port 470*e* to the relief valve 479 via the fuel passage 470 being elongated, the pressure pulsation cause by the fuel being pressure-sent from the fuel pump 42 can be attenuated. Hence, in the relief valve 479, the pressure pulsation can be inhibited from being amplified by the vibration of the valve element 479*b*, so that it is possible to enhance the effect of reducing noise caused in the path from the fuel passage 470 to the internal combustion engine 3.

In still further addition, the jet pump 45 of the present embodiment further throttles and jets out the fuel discharged from the inside passage part 470*g*, which is long extended to thereby throttle the fuel flow in such a way as to satisfy the relational expression of L/D≥3, through the residual pressure holding valve 475, thereby transporting the fuel in the fuel tank 2 to the surroundings of the fuel pump 42. In this way, in the jet pump 45, the fuel in which pressure pulsation is attenuated by the inside passage part 470*g* can be jetted out, so that it is possible to stably exert a fuel transportation function and to inhibit noise harsh to human ears from being caused by the fuel being intermittently jetted out.

In addition to this operation and effect, according to the present embodiment, the most downstream end 476*a* of the relief passage 476 to open toward the inner peripheral face 20*e* of the sub-tank 20 is opposed to the flow-directing part 20*f* of the sub-tank 20. In this way, the flow of the fuel discharged from the relief valve 479 through the most downstream end 476*a* of the relief passage 476 is relieved to the lateral direction, which hence can inhibit the fuel from overflowing from an upper portion of the sub-tank 20.

Although one embodiment has been described above, it should not be understood that the present disclosure is limited to the present embodiment but the present disclosure can be applied to various embodiments within a scope not departing from the gist of the present disclosure. Modified examples of the embodiment described above will be described below.

Specifically, in a first modification, the filter case 43 may be not provided with the relay passage 465 but the fuel outlet 463*a* of the receiving chamber 463 may be substantially matched with the communication port 470*e*. Further, in a second modification, the direction in which the fuel is circulated in the relay passage 465 may be substantially orthogonal to or substantially parallel to the direction in which the fuel is circulated in the inside passage part 470*g*.

In a third modification, the residual pressure holding valve 475 may be provided at the separated position Q which is separated from the relay passage 465 across the inside passage part 470*g* and the inside passage part 470*g* may be opened at a position closer to the relay passage 465 than the separated position Q of the outside passage part 470*f*. Further, in a forth modification, the communication port 470*e* may be opened in the inside passage part 470*g* at the shifted position R, whereby the outside passage part 470*f* may be made to communicate with the communication port 470*e* via the inner passage port 470*g*.

In a fifth modification, at least one of the residual pressure holding valve 475 and the discharge passage 472 may be provided in a portion other than the protruding part 47 at the specified position S of the filter case 43. Further, in a sixth modification, in a construction in which the protruding part 47 is not provided, a non-receiving portion in which the fuel filter 464 is not received of the filter case 43 may be provided at a portion in the peripheral direction of the filter case 43 and the non-receiving portion may be set to the specified position S.

In a seventh modification, the relief valve 479 of an electromagnetically driven type such as a solenoid valve may be provided. Further, in an eighth modification, the relief valve 479 may be not provided. Still further, in a ninth modification, the flow-directing part 20*f* may be not provided.

In a tenth modification, except for the fuel discharged from the inside passage part 470*g* through the residual pressure holding valve 475, for example, the fuel discharged from the fuel pump 42 or the fuel returned from the internal combustion engine 3 side may be jetted out in the jet pump 45. Further, in an eleventh modification, the jet pump 45 may be not provided. Still further, in a twelfth modification, the port member 44 divided into the discharge port 440 and the jet port 441 may be employed.

While the present disclosure has been described with reference to embodiments thereof, it is to be understood that the disclosure is not limited to the embodiments and constructions. The present disclosure is intended to cover various modification and equivalent arrangements. In addition, the various combinations and configurations, other combinations and configurations, including more, less or only a single element, are also within the spirit and scope of the present disclosure.

The invention claimed is:

1. A fuel supply device comprising:

a fuel pump;

a filter case that receives a fuel filter in its receiving chamber, wherein the fuel supply device filters fuel, which is pressure-sent from an interior of a fuel tank by the fuel pump, through the fuel filter and supplies fuel to an internal-combustion engine;

a fuel passage that is provided in the filter case and includes a communication port, which communicates with the receiving chamber on a downstream side of the fuel filter, wherein fuel flows from the communication port through the fuel passage;

a discharge passage that is provided in the filter case and discharges the fuel flowing through the fuel passage into the internal-combustion engine; and a spring-urged type residual pressure holding valve that is provided at the filter case and holds a pressure of fuel in the receiving chamber when the fuel pump is stopped, wherein:

the residual pressure holding valve includes a valve element, which opens the residual pressure holding valve against spring reaction force when the fuel pump is actuated;

the communication port opens at a shifted position of the fuel passage that is positionally shifted from the residual pressure holding valve toward the discharge passage;

the fuel passage includes:

an outside passage part through which fuel flows from the communication port toward the discharge passage; and an inside passage part that throttles along its entire length a flow of fuel flowing from the communication port toward the residual pressure holding valve more than the outside passage part; and when a passage cross-sectional area of the inside passage part is converted into a passage cross-sectional area of a circular pipe, D which is a passage diameter of the circular pipe, and L which is a length of the inside passage part satisfy a relational expression of $L/D \geq 3$.

2. The fuel supply device according to claim 1, further comprising a relay passage that is provided in the filter case to communicate between the receiving chamber and the communication port.

3. The fuel supply device according to claim 2, wherein:

the communication port opens into the outside passage part at the shifted position; and the inside passage part opens at a separated position of the outside passage part that is separated from the relay passage with the residual pressure holding valve between the separated position and the relay passage to communicate with the communication port via the outside passage part.

4. The fuel supply device according to claim 3, wherein a flow direction of fuel through the relay passage is inclined with respect to a flow direction of fuel through the inside passage part, so that the fuel flow from the relay passage turns around toward the inside passage part through the outside passage part.

5. The fuel supply device according to claim 3, wherein:

the filter case includes a protruding part protruding from its specified position in a circumferential direction of the filter case; and the outside passage part and the inside passage part are received in the protruding part together with the residual pressure holding valve at the separated position.

6. The fuel supply device according to claim 1, wherein the communication port opens into the outside passage part at the shifted position to communicate with the inside passage part via the outside passage part.

7. The fuel supply device according to claim 1, wherein the filter case integrally includes the residual pressure holding valve and the discharge passage together with the outside passage part and the inside passage part in a manner deviated at its specified position in a circumferential direction.

8. The fuel supply device according to claim 1, wherein the residual pressure holding valve regulates a pressure of the fuel flowing toward the discharge passage, the fuel supply device further comprising: a spring-urged type relief valve that relieves a pressure of fuel discharged from the inside passage part through the residual pressure holding valve and that includes a valve element, which opens the relief valve against spring reaction force to relieve the pressure.

9. The fuel supply device according to claim 8, further comprising a sub-tank that receives the fuel pump and the filter case in the fuel tank, wherein:

the filter case includes a relief passage that opens toward an inner peripheral surface of the sub-tank;

the relief valve is provided in the relief passage; and the sub-tank includes a flow-directing part that is opposed to a most downstream end of the relief passage to laterally direct a flow of fuel discharged from the relief valve through the most downstream end.

10. The fuel supply device according to claim 1, further comprising a jet pump that throttles and jets out fuel, which is discharged from the inside passage part through the residual pressure holding valve, to transport fuel in the fuel tank to a periphery of the fuel pump.

* * * * *